United States Patent [19]

Yonezawa

[11] Patent Number: 4,812,109

[45] Date of Patent: Mar. 14, 1989

[54] APPARATUS FOR DRIVING PISTON BY FLUID PRESSURE

[75] Inventor: Keitaro Yonezawa, Hyoken, Japan

[73] Assignee: Kabushiki Kaisha Kosmek, Hyogoken, Japan

[21] Appl. No.: 121,911

[22] Filed: Nov. 17, 1987

[30] Foreign Application Priority Data

Nov. 17, 1986 [JP] Japan ..... 61-274836

[51] Int. Cl.[4] ..... F04B 9/12

[52] U.S. Cl. ..... 417/401; 91/313

[58] Field of Search ..... 417/401, 402, 392, 398; 91/287, 307, 313, 304

[56] References Cited

U.S. PATENT DOCUMENTS

| | | | |
|---|---|---|---|
| 485,787 | 11/1892 | Craig | 91/307 |
| 2,361,757 | 10/1944 | Fink | 91/313 X |
| 2,745,387 | 5/1956 | Dinkelkamp | 91/287 |
| 3,019,773 | 2/1962 | Meeker | 91/313 X |
| 3,071,118 | 1/1963 | Wilden | 91/313 X |
| 3,101,030 | 8/1963 | Hyatt et al. | 91/313 X |
| 3,272,081 | 9/1966 | Vedder et al. | 91/313 X |
| 3,489,100 | 1/1970 | Hill | 91/307 |
| 3,609,061 | 9/1971 | Peoples | 417/401 |
| 3,963,383 | 6/1976 | Hill | 417/401 |
| 4,042,311 | 8/1977 | Yonezawa | 417/401 |
| 4,645,431 | 2/1987 | Spencer et al. | 417/401 |

*Primary Examiner*—Leonard E. Smith

*Attorney, Agent, or Firm*—Lowe, Price, LeBlanc, Becker & Shur

[57] ABSTRACT

A piston slidably inserted into a cylinder is reciprocated by fluid pressure such as pneumatic pressure and hydraulic oil and a spring is used to ascend the piston. A spool-shaped pilot valve element is provided to allow a supply-discharge valve disc to take supply and discharge positions, thus fluid pressure being supplied to and discharged from the cylinder. When the supply-discharge disc is actuated to take the supply position from the discharge position, the actuated force (supply position and discharge position) becomes stronger while the supply-discharge valve disc is in operation. When the supply-discharge valve disc is actuated to take the discharge position from the supply position, the back pressure resistance applied to the supply-discharge valve disc become weaker while the supply-discharge valve disc is in operation.

5 Claims, 4 Drawing Sheets

APPARATUS FOR DRIVING PISTON BY FLUID PRESSURE

BACKGROUND OF THE INVENTION

The present invention relates to an apparatus in which a piston is reciprocated by fluid pressure such as pneumatic or hydraulic pressure.

Prior Art

The present inventor invented such an engine as disclosed in U.S. Pat. No. 4,042,311. The basic construction of the engine is shown in FIG. 4 and 5. FIG. 4 is a schematic flow diagram showing the engine. FIG. 5 is a plan view showing the operation of the engine.

The detailed description of the construction and operation of the engine is made hereinafter.

As shown in FIG. 4, an apparatus for driving a piston by fluid pressure comprises an engine 104 and a fluid pressure supply-discharge means 105 (hereinafter referred to as supply-discharge means 105. "fluid pressure" is omitted in the case of other members throughout the specification.) A piston 108 is slidably inserted into a cylinder 107 mounted on the engine 104. An actuation chest 109 is formed between the upper wall 107*a* of the cylinder 107 and the piston 108. The piston 108 is driven in the actuation chest 109 toward its lower dead point by the fluid pressure of the actuation chest 109 and toward its upper dead point by a spring 111. The actuation chest 109 can be connected either to a supply port 114 or to a discharge port 115. A pilot valve 118 allows a supply-discharge valve 113 to take the supply position X' and discharge position Y'. As shown in FIG. 5, the supply-discharge valve 113 positioned above the cylinder 107 is constructed so that a supply-discharge valve disc 130 can be moved upwards and downwards inside a supply-discharge valve casing 129. The supply-discharge valve disc 130 mounted in the supply-discharge valve casing 129 is provided with an operation side valve chest (hereinafter referred to as operation valve chest. "Side" is omitted in the case of other members. For example, supply side valve chest and discharge side valve chest are referred to as supply valve chest and discharge valve chest, respectively.) 132 on the outer circumferential face thereof. The valve disc 130 is also provided with a supply valve chest 133 thereabove and a discharge valve chest 134 and a pilot actuation chest 135 therebelow. The operation valve chest 132 communicates with the actuation chest 109 of the cylinder 107. The supply valve chest 133 communicates with the supply port 114. The discharge valve chest 134 communicates with the discharge port 115. The pilot actuation chest 135 is communicated with the supply port 114 through an O-ring-constructed discharge operation valve element 148 serving for sealing the pilot valve 118. The cross-sectional area of the pilot actuation chest 135 is greater than that of the supply valve chest 134.

The pilot valve 118 is so constructed that a spool-shaped pilot valve element 146 is capable of moving upwards and downwards in a pilot valve chest 145 which extends vertically through a circumferential face 130*d* formed in the center of the supply-discharge valve disc 130. The pilot valve element 146 is connected with the piston 108. When the pilot valve element 146 is in the vicinity of the lower dead point, it opens the discharge operation valve element 148, thereby communicating the pilot actuation chest 135 with the supply port 114. When the pilot valve element 146 is in the vicinity of the upper dead point, it opens a supply operation valve element 153, thereby communicating the pilot actuation chest 135 with a pressure relief hole 151.

The operation of the construction of this conventional apparatus is described hereinafter. In FIG. 5, when a supply valve 116 is opened, fluid pressure such as compressed air or hydraulic oil is supplied from a supply source 117 to the engine 102 through a supply valve 116, thereby the engine 102 being driven. When the valve 116 is closed, fluid pressure is not supplied, with the result that the engine 102 is stopped.

When the engine 102 stops, as shown in the left half in FIG. 5, the piston 108 and the pilot valve element 146 are pushed toward the upper dead point by the spring 111 and the supply-discharge valve disc 130 is pushed toward the discharge valve chest 134.

While the engine 102 is in operation, the piston 108 descends as shown in the left half in FIG. 5 and ascends as shown in the right half in FIG. 5.

While the piston 108 is descending, a supply operation valve element 153 is opened and the fluid pressure in the pilot actuating chest 135 is discharged from the pressure relief port 151, with the result that the supply-discharge valve disc 130 is pushed toward the discharge valve chest 134 by the fluid pressure of the supply valve chest 133 and the pressure ceaselessly supplied to the supply valve chest 133 is introduced from the operation valve chest 132 to the actuation chest 109, thereby the piston being descended.

When the piston 108 reaches the lower dead point, the discharge operation valve element 148 is opened as shown in the right half in FIG. 5 and the fluid pressure ceaselessly supplied from the supply port 114 is drawn into the pilot actuation chest 135, with the result that the supply-discharge valve disc 130 is pushed toward the supply-discharge valve chest 133 by the fluid pressure in the pilot actuation chest 135, and the fluid pressure in the actuation chest 109 is discharged from the discharge port 115 through the operation valve chest 132 and the discharge valve chest 134, thereby the piston being pushed upwards toward the upper dead point by the spring 111.

When the piston 108 reaches the upper dead point, the supply operation valve element 153 is opened as shown in the left half in FIG. 5. Thus, the piston starts descending. The supply-discharge valve 113 and the pilot valve 118 provided with the conventional apparatus are constructed as shown in FIGS. 5 and 6. The supply valve chest 133 is disposed at an upper portion of the supply-discharge valve disc 130, and the discharge valve chest 134 and the pilot actuation chest 135 are disposed at lower portions of the supply-discharge valve disc 130. The diameter A' of a supply valve-face 130*a* which confronts the supply valve chest 133 of the supply-discharge valve disc 130 is formed to be same as the diameter B' of a discharge valve-face 130*b* which confronts the discharge valve chest 134 of the supply-discharge valve disc 130. The area D' of the closed supply valve-face 130*a* which receives pressure when it starts to open is formed to be same as the area E' of the closed discharge valve-face 130*b* which receives pressure when the supply valve-face 130*a* has finished opening. The inner circumferential face 148*a* of a sealing ring-constructed discharge operation valve element 148 and the outer circumferential face 148*b* thereof slidably seal the pilot valve element 146 and the inner circumferential face 129c mounted on a lower portion of the valve casing 129, respectively. The upper face 148c of the discharge operation valve element 148 is received by a receiving member 149 at the lower face thereof and the upper portion of the receiving member 149 is fixed to the supply-discharge valve disc 130.

In FIG. 6, reference numeral 130c denotes the face which fluid pressure is applied from the pilot actuation chest 135 to the supply-discharge valve disc 130 and reference numeral F' denotes the area which the supply-discharge valve disc 130 receives pressure from the pilot actuation chest 135.

In this prior art apparatus, the pilot valve element 146 is directly actuated to ascend or descend by the piston 108. Therefore, no delay occurs in the operation of the pilot valve element 146, i.e., the pilot valve element readily reacts to the operation of the piston 108, which allows the piston to move fast, thus resulting in the generation of high output from the engine 102.

The prior art apparatus has, however, the following disadvantages described in items (1) through (3) below.

(1) The actuation mechanism for the change-over of the supply-discharge valve disc 130 has room to be improved.

When the supply-discharge valve disc 130 is actuated to move upwards toward the discharge position Y' as shown in the right half in FIG. 5, the O-ring-constructed discharge operation valve element 148 is pushed upwards by fluid pressure. When the supply-discharge valve disc 130 is actuated to move downwards to the supply position X' shown in the left half in FIG. 5, the discharge valve element 148 is pushed downwards by the receiving member 149 mounted below a lower portion of the supply-discharge valve disc 130 while it is slidably contacting with the inner circumferential face 129c of the valve casing 129 and the outer circumferential face 118a of the pilot valve 118.

Thus, when the movement of the supply-discharge valve disc 130 is descending to the supply position X', it is subjected to frictional resistance from four members, namely the inner circumferential face 148a and the outer circumferential face 148b of the discharge operation valve element 148, the O-ring 142 for sealing the pilot actuation chest 135, and the O-ring 190 for sealing the supply valve chest 133.

Of the above-described four members, the O-ring 190 is most resistant to the movement of the supply-discharge valve disc 130: The lower half of the sealing O-ring 190 is ceaselessly subjected to a high fluid pressure of the supply valve chest 133, whereas the upper half thereof opens outside through a pilot valve chest 145, a pressure relief port 151, and the discharge valve chest 134. This causes the O-ring 190 to be pressed upwards and elongated in the width direction thereof by a high pressure thus generated, and strongly pushed against a slide guide face 191.

Accordingly, the actuation speed in the change-over of the supply-discharge valve disc 130 is slow to a great extent, which reduces the actuation speed of the engine 102, thus resulting in the reduction of the output thereof.

(2) Actuation errors occur in the engine 102.

If a compressor is actuated with the supply valve 116 open by mistake so as to increase the pressure of the air supply source (fluid pressure source) 117 from the atmospheric pressure up to a predetermined pressure, the supply-discharge valve disc 130 may be stopped while the change-over of the supply-discharge valve disc 130 is being carried out, which leads to the non-actuation of the engine 102 for the following reason.

Before the engine 102 is actuated, the piston 108 is pushed up by the spring 111 and the pilot valve element 146 opens the supply operation valve element 153 in the vicinity of the upper dead point of the piston 108, so that the pressure in the pilot actuation chest 135 is discharged from the pressure relief port 151. As a result, the supply-discharge valve disc 130 is disposed at the supply position X' as shown in the left half in FIG. 5.

When a compressor is actuated by mistake with the supply valve 116 open, the pressure in the fluid pressure supply source 117 rises gradually. As a result, the pneumatic pressure to be supplied to the engine 102 also rises.

In the early period of the pneumatic pressure rise, the piston 108 is driven to descent at a very low speed. When the piston 108 is in the lower dead point, the groove 146a for opening the pilot valve element 146 passes the discharge operation valve 148 at a very low speed. When the discharge operation valve 148 is opened by the groove 146a to a slight extent, compressed air with a low pressure is drawn into the pilot actuation chest 135 so as to push up the supply-discharge valve disc 130 slowly against a great frictional resistance of the O-ring 142 and 190.

While the supply-discharge valve disc 130 is being pushed up slowly, the operation valve chest 132 is communicated with the supply valve chest 133 and the discharge valve chest 134, with the result that the pressure in the actuation chest 109 is introduced from the operation valve chest 132 to the discharge valve chest 134. Caused by this occurrence, the piston 108 is pushed up by the spring 111. As a result, the discharge operation valve element 148 which has been opened to a small degree is closed by the valve-opening groove 146a.

As a result, compressed air with a low pressure is not allowed to be discharged from the pilot actuation chest 135 and the compressed air with a low pressure in the supply valve chest 133 is biased to the discharge valve chest 134 through the operation valve chest 132.

Consequently, the supply-discharge valve disc 130 is stopped from ascending before it reaches the supply position Y' because the push-up force generated by the pressure in the pilot actuation chest 135 is balanced with the push-down force generated by the pressure in the supply valve chest 133. Therefore, the piston 108 is not driven to descend, which leads to the non-actuation of the engine 102.

At this time, compressed air is biased from the supply valve chest 133 to the discharge valve chest 134, so that the compressed air is discharged from the discharge port 115. Thus, energy is wasted and hydraulic actuators installed at various places in a factory cannot be driven because the pressure in the air supply source 117 does not rise.

(3) The engine 102 is stopped when it is driven at a very low speed.

As shown in FIG. 4, when a plunger-type hydraulic pump 103 is driven by the engine 102 and pressure is kept applied after a hydraulic cylinder 161 is elongated, pressure oil may leak from an actuation chest 161a or a selector valve 160. In this case, the piston 108 drives the plunger 122, provided with the hydraulic pump 103, at a low speed in order to supplement the amount of oil which has leaked.

When the piston 108 approaches its lower dead point at a very low speed, the valve-opening groove 146a passes the discharge operation valve element 148 at a very low speed. At this time, the discharge operation valve element 148 is opened to a small extent by the valve-opening groove. As a result, as described above in the item Disadvantage (2), the supply-discharge valve disc 130 stops during its ascent, which causes the engine 102 to stop.

SUMMARY OF THE INVENTION

It is the principal object of the present invention to provide an apparatus for driving a piston by fluid pressure having a high output which can be brought about by increasing the actuation speed of the change-over of a supply-discharge valve disc.

It is another object of the present invention to provide an apparatus in which an engine is not prevented from driving when it is actuated.

It is still another object of the present invention to provide an apparatus for driving a piston in which an engine is not prevented from stopping when it is driven at a very low speed.

In order to achieve these objects, an apparatus according to the present invention has the following improved construction.

An apparatus for driving an engine by fluid pressure according to the present invention is characterized in that pressure fluid supply valve chest is provided below a supply-discharge valve disc; and a discharge valve chest and a pilot actuation chest are provided above the supply-discharge valve disc; and the diameter of the supply valve face, of the supply-discharge valve disc, which confronts the supply valve chest is smaller than the diameter of the discharge valve-face, of the supply-discharge valve disc, which confronts the discharge valve chest, and the area of the supply valve-face which has been closed and receives pressure when the supply valve-face starts to open is smaller than the area of the supply valve-face which receives pressure when the supply valve-face has finished opening with the discharge valve face closed, and the area of the supply-discharge valve face which confronts the pilot actuation chest and receives pressure from the pilot actuation chest is greater than the area of the discharge valve-face which receives pressure when the supply valve-face has finished opening, and the inner circumferential face of a sealing ring-constructed discharge operation valve element and the outer circumferential face thereof slidably contact with a pilot valve element and the cylindrical circumferential face of the supply-discharge valve disc, respectively so as to be sealed, and the upper face of the discharge operation valve element is received by the lower face of a receiving member, and the upper portion of the receiving member is fixed to a supply-discharge valve casing.

BRIEF DESCRIPTION OF THE DRAWINGS

FIG. 1 illustrates the operation of an apparatus according to the present invention in which principal portions shown in FIG. 2 are enlarged.

FIG. 2 is a longitudinal sectional view of a booster pump which is applied to an apparatus for driving a piston by fluid pressure according to the present invention.

FIG. 3 is a view showing pressure receiving areas of a supply-discharge valve disc when it has taken a discharge position.

FIGS. 5 and 6 show an embodiment of a conventional apparatus in which FIG. 5 is a longitudinal sectional view of an engine for driving a piston by fluid pressure and FIG. 6 is an illustration corresponding to FIG. 3.

DESCRIPTION OF THE PREFERRED EMBODIMENTS

The present invention will become more fully understood from the following description of some preferred embodiments thereof, which is to be taken in conjunction with the accompanying drawings. It should be clearly understood, however, that the description of the embodiments, and the drawings, are all provided purely for the purpose of illustration only, and are in no way to be taken as limitative of the scope of the present invention.

Embodiments of the present invention are described hereinafter with reference to FIGS. 1 through 3.

Figure 2:
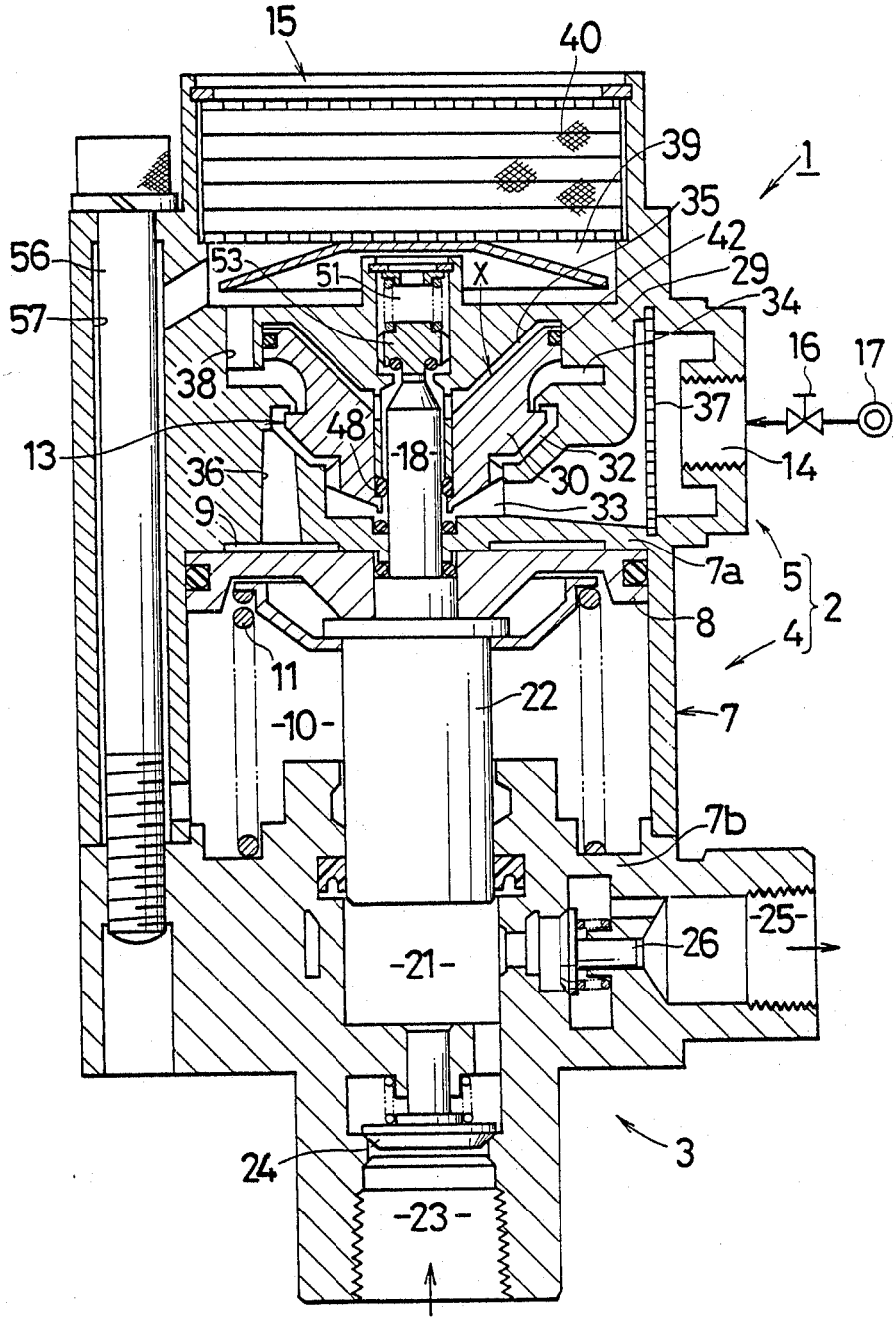
Figure 4:
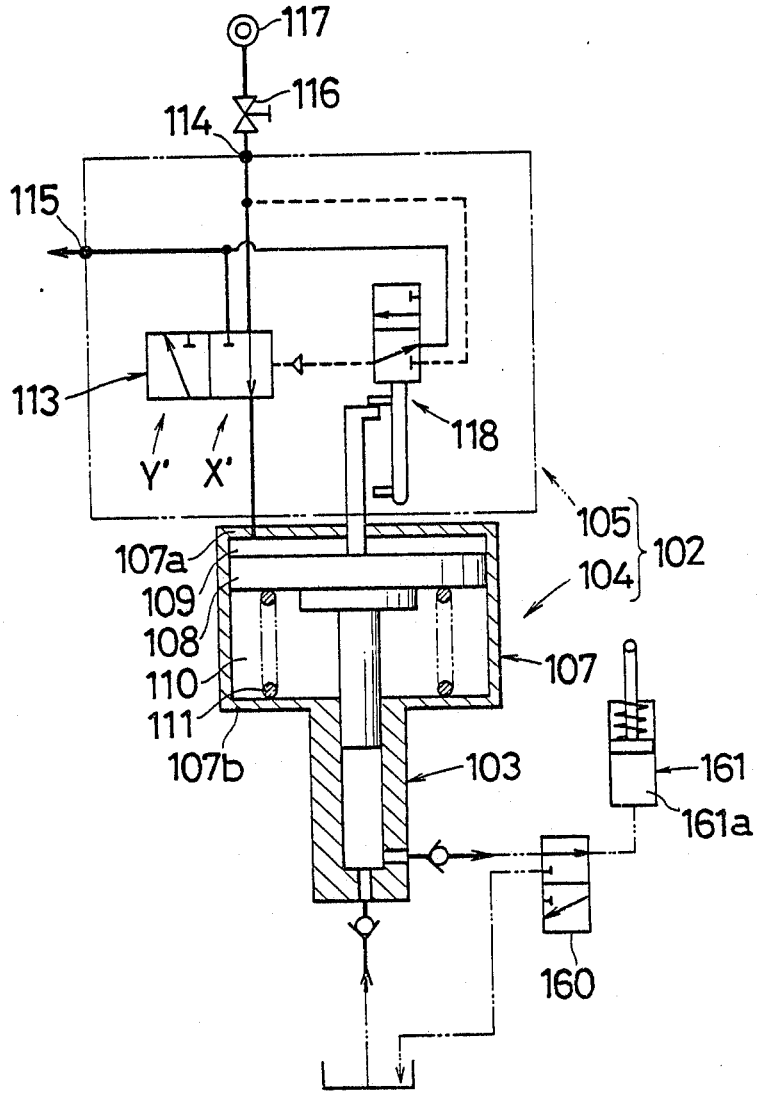
FIG. 4 is a schematic flow diagram showing an apparatus to which an engine for driving a piston by fluid pressure is applied.

In FIG. 2, reference numeral 1 denotes a booster pump which comprises an engine 2 in which a piston is driven by pneumatic pressure so as to reciprocate the piston by compressed air and a plunger-type hydraulic pump 3 to be driven by the engine 2, thereby feeding out a high pressure oil.

The engine 2 comprises a main engine 4 which changes energy of compressed air into power. Compressed air is supplied to or discharged from the main engine 4 through fluid pressure supply-discharge means 5.

The main engine 4 includes a single acting spring. More specifically, a piston 8 is inserted into a cylinder 7 so that the piston 8 may slide along the cylinder 7 in an air-tight manner. An actuation chest 9 is formed between the upper wall of the cylinder 7 and the upper face of the piston 8. A spring chest 10 is formed between the lower wall of the cylinder 7 and the lower face of the piston 8. A spring 11 is mounted in the spring chest 10. The piston 8 is driven toward the lower dead point against the urging force of the spring 11 when compressed air is supplied to the actuation chest 9. The piston 8 is driven toward the upper dead point by the spring 11 when compressed air is discharged from the actuation chest 9.

The supply-discharge means 5 includes a supply-discharge valve 13 through which the actuation chest 9 is connected either to a supply port 14 or to a discharge port 15. The supply port 14 is connected to a pneumatic pressure supply source (hereinafter referred to as supply source) 17 through a fluid pressure supply valve (hereinafter referred to as supply valve) 16. The discharge port 15 opens outside. The pilot valve 18 allows the supply-discharge valve 13 to take the supply position X and the discharge position Y (refer to FIG. 1.)

The plunger-type hydraulic pump 3 is known in the art, that is, in the pump 3, a plunger 22 is inserted into a cylindrical pump chamber 21 so as to be vertically slidable along the pump 21 in an oil-tight manner and the plunger 22 is connected to the piston 8. A suction valve 24 is mounted on a suction port 23 which opens outside at the bottom of the pump chamber 21 and a discharge valve 26 is mounted on a discharge port 25 which opens outside at the peripheral wall of the pump chamber 21.

When the piston 8 is actuated to descend, the plunger 22 moves downwards into the pump chamber 21, so that the pressure in the pump chamber 21 rises and the discharge valve 26 is opened. As a result, the hydraulic oil in the pump chamber 21 is discharged. When the piston 8 moves upwards, the plunger 22 moves upwards from the pump chamber 21, with the result that the pressure in the pump chamber 21 drops and the suction valve 24 is opened, thereby hydraulic oil being drawn into the pump chamber 21. Thus, a high pressure hydraulic oil is drawn into or discharged from the pump chamber 21.

The detailed description of the supply-discharge means 5 provided with the booster pump 1 is made hereinafter with reference to principally FIG. 1. The left half in FIGS. 1 and 2 show the piston 8 which has started to descend. The right half in FIG. 1 shows the piston 8 which has started to ascend.

The supply-discharge valve 13 is mounted on a supply-discharge valve casing 29 disposed at an upper portion of the cylinder 7. A cylindrical supply-discharge valve disc 30 is inserted into the supply-discharge valve casing 29. The cylindrical face **30*d* of the supply-discharge valve disc 30 is supported by a support cylinder 31 extending downwards from the supply-discharge valve casing 29 so that the cylindrical face 30*d* is vertically slidable along the support cylinder 31. The supply-discharge disc 30** is disposed at the supply position X when it is pushed upwards and the position Y when it is pushed downwards.

An operation valve chest 32 is formed on the outer circumferential face of the supply-discharge disc 30 mounted in the supply-discharge valve casing 29. A supply valve chest 33 is formed at a lower portion, namely, one end face of the supply-discharge valve disc 30. A discharge valve 34 and a pilot actuation chest 35 are formed on an upper portion, namely, the other end face of the supply-discharge valve disc 30. The pilot actuation chest 35 is disposed above the discharge valve chest 34. The operation chest 32 communicates with the actuation chest 9 of the cylinder 7 through a supply-discharge port 36. The supply valve chest 33 communicates with the supply port 14 through a filter 37. The discharge valve chest 34 communicates with the discharge port 15 through a discharge port 38. A silencer 40 is mounted in a discharge chamber 39 formed in the discharge port 15.

A supply valve-face **30*a* which confronts the supply valve chest 33 is mounted on the supply-discharge valve disc 30. A discharge valve-face 30*b* which confronts the discharge valve chest 34 is mounted on the supply-discharge valve disc 30. In this case, the diameter A of the supply valve-face 30*a* is smaller than the diameter B of the discharge valve-face 30*b***.

Figure 1:
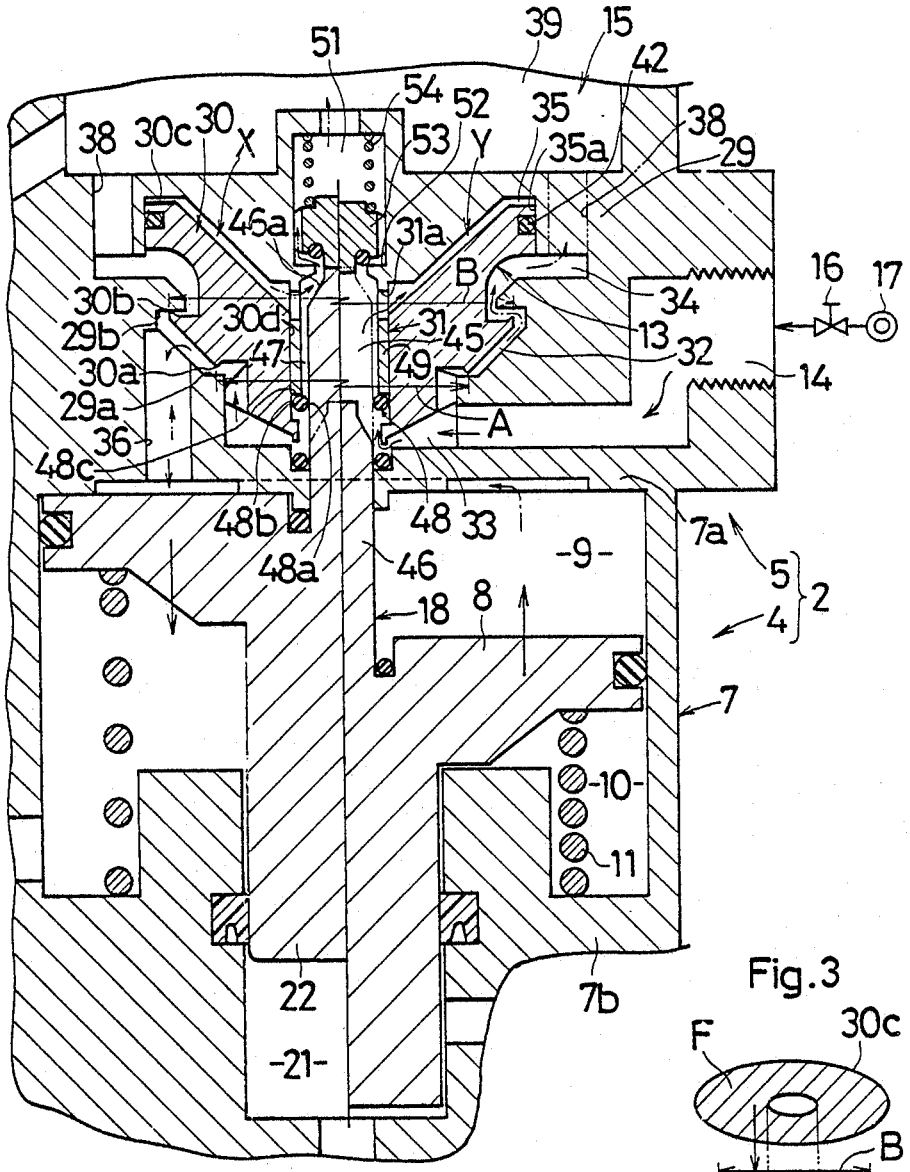
FIG. 1 through 3 show embodiments of the present invention.
Figure 3:
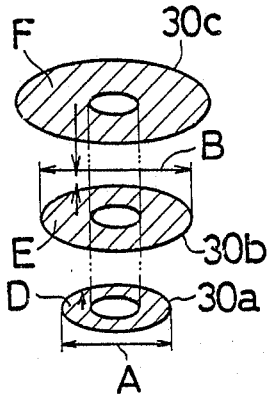

As shown in FIG. 3, the area D of the supply valve-face **30*a* which receives pressure when it starts to open (refer to the right half in FIG. 1) is smaller than the area E of the closed discharge valve-face 30*b* which receives pressure when ,the supply valve-face 30*a* has finished opening (refer to the left half in FIG. 1). The valve-face 30*c*, confronting the pilot actuation chest 35, which receives pressure therefrom is formed in the supply-discharge valve disc 30. The pressure receiving area F of the valve-face 30*c* is greater than the area E of the discharge valve-face 30*b* which receives pressure when the supply valve-face 30*a*** has finished opening.

When the supply-discharge valve disc 30 is pushed up so that it take the supply position X as shown in the left half in FIG. 1, the supply valve-face **30*a* moves away from a supply valve seat 29*a*, with the result that the supply valve chest 33 is communicated with the operation valve chest 32 and the discharge valve-face 30*b* is brought into contact with a discharge valve seat 29*b*, whereby the space between the operation valve chest 32 and the discharge valve chest 34 is sealed. As shown in the right half in FIG. 1, when the supply-discharge disc 30 is pushed downwards to take the discharge position Y, the supply valve-face 30*a* is brought into contact with the supply valve seat 29*a*. As a result, the space between the supply valve chest 33 and the operation valve chest 32 is sealed, and the discharge valve-face 30*b* moves away from the discharge valve seat 29*b*, thereby the operation valve chest 32 being communicated with the discharge valve chest 34**.

The space between the discharge valve chest 34 and the pilot actuation chamber 35 is air-tightly sealed by a pilot actuation chest-sealing O-ring which has engaged with the upper peripheral face of the supply-discharge valve disc 30. The pilot actuation chest 35 is communicated either with the supply port 14 or the discharge port 15 through the pilot valve 18, whereby the change-over of the supply-discharge valve disc 30 is carried out.

The description of the pilot valve 18 is described hereinafter. A pilot valve chest 45 vertically extends through the cylindrical circumferential face **30*d* of the supply-discharge valve disc 30. A spool-shaped pilot valve element 46 is inserted into the pilot valve chest 45 with a predetermined space provided radially between the pilot valve element 46 and the circumferential face of the support cylinder 31. The pilot valve element 46 is connected to the piston 8**.

A tubular ventilation passage 47 is formed between the circumferential face of the support cylinder 31 and the outer circumferential face of the pilot valve element 46. The supply valve chest 33 communicates with the pilot actuation chest 35 through a hole **31*a* which communicates the ventilation passage 47 with the support cylinder 31. A discharge operation valve element 48 serving as an O-ring is provided to open or close the ventilation passage 47. The inner circumferential face 48*a* and the outer circumferential face 48*b* of the valve element 48 slidably contact with the outer circumferential face of the pilot valve element 46 and the circumferential face 30*d* of the supply-discharge valve disc 30, respectively so as to be sealed by the discharge valve operation element 48. The upper face 48*c* of the discharge operation valve element 48 is received by a receiving member 49 mounted on a lower portion of the support cylinder 31. The pilot valve element 48 is tapered to the top end thereof and a valve-opening groove 46*a*** is mounted on the upper portion thereof.

A cylindrical pressure relief port 51 is formed to be coaxial with and above a pilot valve element chest 45. A pressure relief valve seat 52 is formed at the bottom of the pressure relief port 51 such that the diameter of the valve seat 52 is smaller than that of the pressure relief port 51. A supply-discharge valve disc 53 vertically slidably inserted into the pressure relief port 51 is pressed by a valve-closing spring 54 toward the pressure relief valve seat 52.

When the pilot valve element 46 is actuated to descend with the descent of the piston 8, that is, when the pilot valve element 46 descends from the position in the vicinity of the upper dead point as shown by the solid line in the left half in FIG. 1 to the position in the vicinity of the lower dead point as shown by the two-dot chain line in the left half in FIG. 1, the supply operation valve element 53 is brought into contact with the pressure relief valve seat 52, with the result that the pressure relief port 51 is closed. Then, the discharge operation valve element 48 engages with a groove 46a adapted to close the pilot valve element 46, thereby the ventilation passage 47 for the pilot valve chest 45 being opened. At this time, the pilot actuation chest 35 is communicated with the supply port 14 through the communication hole 31a of the support cylinder 31, the ventilation passage 47 for the pilot valve chest 45, the valve-opening groove 46a, and the supply valve chest 33. Thus, the supply-discharge valve disc 30 is pushed downwards by the pressure difference between the upper and lower spaces thereof, with the result that the change-over of the supply-discharge valve disc 30 is carried out, namely, from the supply position X to the discharge position Y (refer to the right half in FIG. 1). The actuation chest 9 is, at this time, communicated with the discharge port 15 through the supply-discharge hole 36, the operation valve chest 32, the discharge valve casing 34, and the discharge hole 38, thereby the piston 8 starting to ascend.

When the pilot valve element 46 is actuated to ascend from the position in the vicinity of the lower dead point as shown by the solid line in the right half in FIG. 1 to the position in the vicinity of the upper dead point as shown by the two-dot chain line in the right half in FIG. 1, the outer circumferential face of the pilot valve element 46 is sealed by the inner circumferential face 48a of the discharge operation valve element 48, with the result that the ventilation passage 47 is closed. Then, the supply operation valve element 53 is pushed upwards against the urging force of the valve-closing spring 54 and moves away from the pressure relief valve seat 52. Consequently, the pilot actuation chest 35 is communicated with the discharge port 15 through the communication hole 31a of the support cylinder 31, the valve-opening groove 46a, and the pressure relief port 15.

Thus, the supply-discharge valve disc 30 is pushed upwards by the pressure difference between the upper and lower spaces thereof, with the result that the change-over of the supply-discharge valve disc 30 is carried out, namely, from the discharge position Y to the supply position X (refer to the left half in FIG. 1). At this time, the actuation chest 9 is communicated with the pressure supply port 14 through the supply-discharge opening 36, the operation valve chest 32, and the supply valve chest 33, thereby the piston 8 starting to descend.

As shown in FIG. 2, the engine 2 is connected to the hydraulic pump 3 with a plurality of tie rods 56. The spring chamber 10 of the main engine 4 is communicated with the discharge chest 39 through a ventilation hole 57 of the tie rods 56. Accordingly, the noise generated in the spring chamber 10 during the ascent of the piston 8 is absorbed by the silencer 40.

The operation of the apparatus according to the present invention is described hereinafter. p1 (1) The actuation speed of the supply-discharge valve disc 30 is fast when the change-over thereof is carried out.

Figure 5:
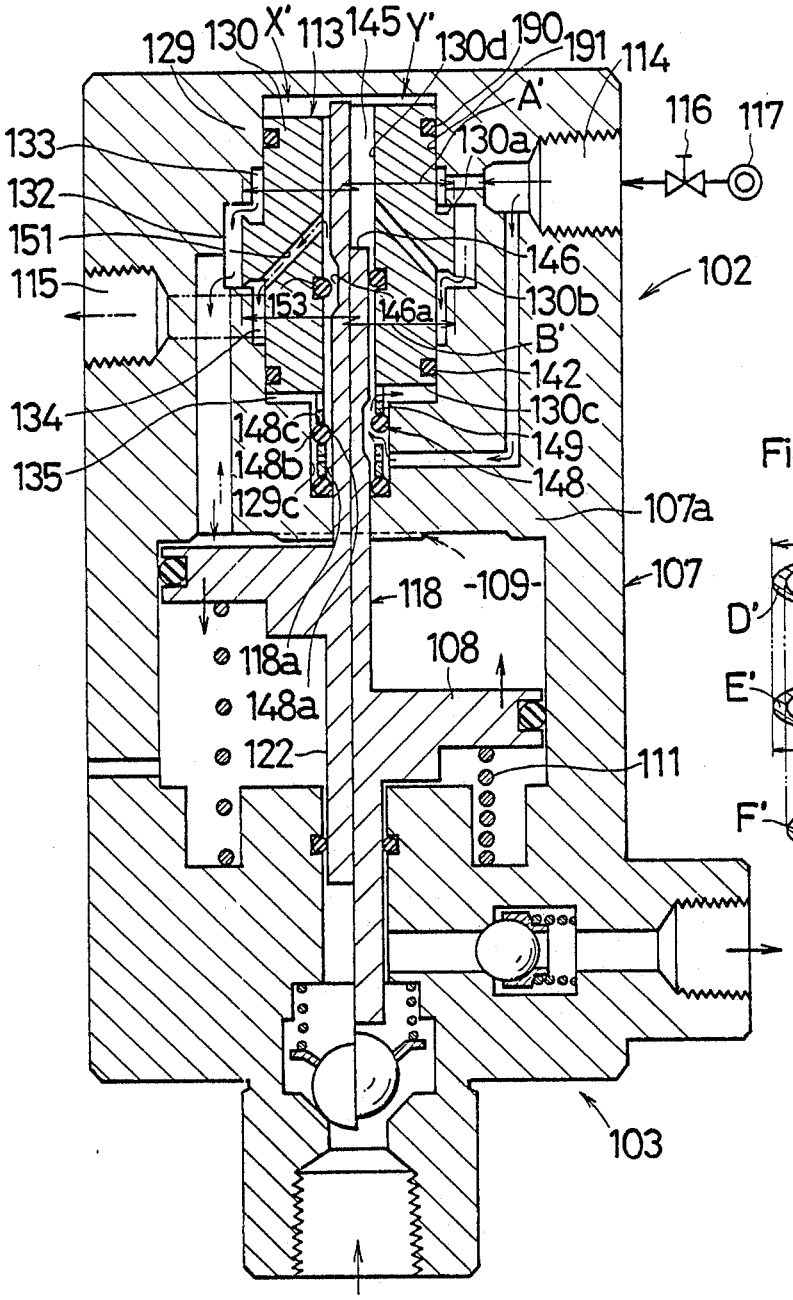
Figure 6:
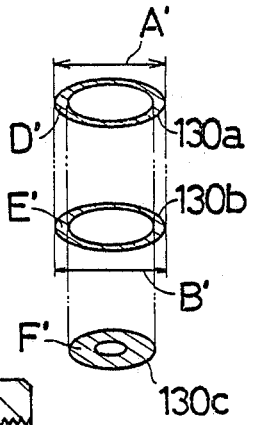

The supply-discharge valve disc 30 slides along the circumferential face 35a of the pilot actuation chest 35 and is received by the receiving member 49 and subjected to frictional resistance from the O-ring 42 for sealing the pilot actuation chest 35 and the outer circumferential face 48b of the discharge operation valve element 48. Compared with the conventional supply-discharge valve disc 130 which is subjected to frictional resistance from four members (refer to FIGS. 5 and 6), the supply-discharge valve disc 30 according to the present invention is subjected to frictional resistance from two members. The frictional resistance to be applied to the prior art O-ring 190 for sealing the supply valve casing 133 is strong because it is ceaselessly strongly pushed by the force from above and below it. Accordingly, the frictional resistance to be applied to the supply-discharge valve disc 130 is very strong. According to the present invention, a sealing member corresponding to the O-ring 190 is not provided. As such, the frictional resistance to be applied to the supply-discharge valve disc 30 is much less stronger than that to be applied to the prior art supply-discharge valve disc 130.

The operation force in an early period in carrying out the change-over of the supply-discharge valve disc 30 by the fluid pressure of the supply valve chest 33 from the discharge position Y to the supply position X shown in the left half in FIG. 1 corresponds to the pressure to be applied to the receiving area D of the supply valve-face 30a which has started to open. During the middle through later period, the supply valve-face 30a is opened and the discharge valve-face 30b is closed. Therefore, the above-described operation force is changed to the force corresponding to the pressure to be applied to the area E, greater than D, of the discharge valve-face 30b which receives pressure when the supply valve-face 30a has finished opening. Owing to this mechanism, the actuation speed in carrying out the change-over of the supply-discharge valve disc 30 is accelerated in this period.

When the supply-discharge valve disc 30 is actuated to change from the supply position X to the discharge position Y by the fluid pressure in the pilot actuation chest 35, the fluid pressure in the supply valve chest 33 acts as the back pressure resistance. In the early period in which the valve disc 30 is actuated, the back pressure resistance force corresponds to the pressure to be applied to the area E of the discharge valve-face 30b which receives pressure when the supply valve disc face 30a has finished opening, whereas during the middle through later period of the valve disc 30 change-over from the position X to Y, the supply valve-face 30a is closed and the discharge valve-face 30b is opened. Accordingly, the back pressure resistance force changes to the force corresponding to the pressure to be applied to the area D, smaller than E, of the discharge valve-face 30b which receives pressure when the supply valve-face 30a has started opening whereby the actuation speed in carrying out the change-over of the valve disc 30 is accelerated in this period.

As described above, the actuation speed in the valve disc change-over according to the present invention is much faster than that according to the prior art owing to the reduction of frictional resistance to be applied to the supply-discharge valve disc 30, the increase of the operation force in the valve disc change-over, and the reduction of the back pressure resistance to be applied to the supply-discharge valve disc 30 when the valve disc change-over is performed. Owing to this, the piston 8 reciprocates very fast, so that the output of the engine 2 increase to a great extent.

(2) No error occurs in the engine actuation.

When a compressor is actuated with the supply valve 16 open by mistake so as to increase the pressure in the supply source 17 from the atmospheric pressure up to a predetermined pressure, with the supply-discharge valve disc 30 suspended at the supply position X as shown in the left half in FIG. 1, the pressure of compressed air supplied from the supply valve chest 33 to the actuation chest 9 gradually rises as well.

Caused by this, the piston 8 is driven to descend under a low pressure. When the piston 8 approaches the lower dead point thereof, the valve-opening groove 46*a* disposed at the upper end of the pilot valve element 46 opens the discharge operation valve element 48 when it passes it at a very low speed. At this time, compressed air with a low pressure flows into the pilot actuation chest 35, thereby the supply-discharge valve disc 30 being pushed downwards slowly.

Before the supply-discharge valve disc 30 is pushed downwards, the back pressure resistance acts as the force corresponding to the pressure to be applied to the area E of the discharge valve-face 30*b* which receives pressure when the supply valve-face 30*a* has finished opening. After the supply-discharge valve disc 30 is pushed downwards, the supply valve-face 30*a* is closed and the discharge valve-face 30*b* is opened, with the result that the back pressure resistance changes to the force corresponding to the pressure to be applied to the area D of the supply valve-face 30*a*, smaller than D, which receives pressure when it has started opening. Thus, the back pressure resistance is reduced very quickly.

Thus, the supply-discharge valve disc 30 is strongly pushed downwards, so that it is not prevented from stopping halfway toward the lower dead point thereof, whereby no error occurs in the actuation of the engine 2.

(3) The engine 2 does not stop when the piston 8 is driven at a very low speed.

There is a case in which the piston 8 is driven at a very low speed for some reason. In this case, with the approach of the piston 8 to the lower dead point, the valve opening groove 46*a* mounted on the upper end of the pilot valve element 46 is opening the discharge operation valve element 48 when the groove 46*a* passes the valve element 46 at a very low speed. At this time, the valve disc 30 is strongly pushed downwards due to the reduction of the back pressure resistance as in the case of the operation described in the item (2) above, thereby the supply-discharge valve disc 30 being not prevented from descending. Accordingly, the engine 2 is not stopped even though the piston 8 is being driven at a very low speed.

The following advantages can be obtained by the above-described construction and operation.

(1) The actuation speed in the change-over of the supply-discharge valve disc 30 increases to a great extent owing to the reduction of frictional resistance, the increase of the operation force in the valve disc change-over, and the reduction of the back pressure resistance to be generated in the actuation of the valve disc 30 when the valve disc change-over thereof is carried out. By virtue of this, the piston 8 reciprocates at a very high speed, and as such, the output of the engine 2 increases to a great extent.

(2) When the supply-discharge valve disc 30 is slowly pushed downwards by the pressure of the pilot actuation chest 35 from the supply position X to the discharge position Y, the back pressure resistance to be generated in the valve-pushdown reduces from the pressure to be applied to the area E of the discharge valve-face which receives pressure when the supply valve-face 30*a* has finished opening to the pressure to be applied to the area D of the supply valve-face, smaller than E, which receives pressure when it has started to open. Accordingly, the supply-discharge valve disc 30 is pushed downwards strongly, thereby not being prevented from stopping during its descent.

Owing to this, the supply-discharge valve disc 30 does not stop halfway when the pressure of the supply source 17 rises from the atmospheric pressure up to a predetermined pressure by actuating a compressor, thereby the engine 2 being reliably actuated.

Further, compressed air is not biased from the supply valve chest 33 to the discharge valve chest 34. Therefore, energy is not wasted, and hydraulic actuators installed at various places in a factory are reliably driven even though the pressure in the supply source 17 does not rise.

(3) There is a case in which the piston 8 is driven at a very low speed for some reason. In this case, when the pilot valve element 46 opens the discharge operation valve element 48 slowly and when the supply-discharge valve disc 30 is slowly pushed downwards by the pressure, in the pilot actuation chest 35, which is slowly rising, the supply-discharge valve disc 30 does not stop halfway when it is descending because of the reduction of the back pressure resistance. Thus, the change-over of the supply-discharge valve disc 30 is securely accomplished, thereby the engine 2 not being prevented from stopping.

In the above-described embodiment, the engine 2 is driven by pneumatic pressure, however, it may be driven by gas or hydraulic fluid. The engine 2 is used to drive the hydraulic pump 3 in this embodiment, however, any other apparatuses may be used to drive the hydraulic pump 3 unless they are capable of changing a linear motion into a mechanical work.

What is claimed is:

1. In an apparatus for driving a piston by fluid pressure, wherein a piston is slidably inserted into a cylinder; an actuation chest is formed between the upper wall of the cylinder and the piston; the piston is driven toward the lower dead point thereof by the fluid pressure in the actuation chest and toward the upper dead point thereof by a spring; and the actuation chest is connected either to a supply port or to a discharge port through a supply-discharge valve; and a pilot valve allows the supply-discharge valve to take the supply position X and the discharge position Y; and the supply-discharge valve is so constructed that the supply-discharge valve is a disc disposed above the cylinder movable up to the upper dead point and down to the lower dead point in a supply-discharge valve casing; and in the supply-discharge valve casing, an operation valve chest is formed on the outer circumferential face of the supply-discharge valve disc, and a supply valve chest is disposed one side of supply-discharge valve disc; and a discharge valve chest and a pilot actuation chest are disposed another side of the supply-discharge valve disc; and the operation valve chest, the supply valve chest, and the discharge valve chest are communicated with the actuation chest of the cylinder, the supply port, and the discharge port, respectively; and the pilot actuation chest is communicated with the supply port through a sealing ring-constructed discharge operation valve element of the pilot valve; and the cross-sectional area of the pilot actuation chest is greater than the cross-sectional area of the supply valve chest; and the pilot valve is so constructed that a spool-shaped pilot valve element is movable up and down in a pilot valve chest which extends vertically through a cylindrical face mounted in the center of the supply discharge valve disc; and a pilot valve element is connected with the piston; and when the pilot valve element is in the vicinity of the lower dead point, it opens the discharge operation valve element so as to communicate the pilot valve actuation chest with the supply port and when the pilot valve element is in the vicinity of the upper dead point, it opens a supply operation valve element so as to communicate the pilot actuation chest with a pressure relief port, comprising: the supply valve chest disposed below the supply-discharge valve disc, and the discharge valve chest and the pilot actuation chest disposed above the supply-discharge valve disc, wherein the diameter of the supply valve-face, of the supply-discharge valve disc, which confronts the supply valve chest is smaller than the diameter of the discharge valve face, of the supply-discharge valve disc, which confronts the discharge valve chest; and the area of the supply valve-face which has been closed and receives pressure when the supply valve-face starts to open is smaller than the area of the discharge valve-face which receives pressure when the supply valve-face has finished opening with the discharge valve face closed; and the area of the valve-face which confronts the pilot actuation chest and receives pressure from the pilot actuation chest is greater than the area of the discharge valve-face which receives pressure when the supply valve-face has finished opening; and the inner circumferential face of a sealing ring-constructed discharge operation valve element and the outer circumferential face thereof slidably contact with a pilot valve element and the cylindrical circumferential face of the supply-discharge valve disc, respectively so as to be sealed by the sealing ring-constructed discharge operation valve element; and the upper face of the discharge operation valve element is received by the lower face of a receiving member, and the upper portion of the receiving member is fixed to a supply-discharge valve casing.

2. An apparatus for driving a piston by fluid pressure as claimed in claim 1, wherein a support cylinder extends downwards from the supply-discharge valve chest, and the cylindrical circumferential face of the supply-discharge valve disc is supported by the outer circumferential face of the support cylinder so as to be vertically slidable in contact with therewith; and ventilation passage is formed between the inner circumferential face of the support cylinder and the outer circumferential face of the pilot valve element; and the supply valve chest is communicated with the pilot actuation chest through the ventilation passage; and the receiving member is mounted on the lower portion of the support cylinder.

3. An apparatus for driving a piston by fluid pressure as claimed in claim 1, wherein the pressure relief port is formed above the pilot valve chest; and a pressure relief valve seat is formed at the bottom of the pressure relief port such that the diameter thereof is smaller than that of the pressure relief port; and the supply operation valve element inserted vertically slidably into the pressure relief port is pressed to the pressure relief valve seat by a valve-closing spring; and a valve-opening groove is provided by tapering the pilot valve element up to the top thereof; and when the pilot valve element is positioned in the vicinity of the lower dead point thereof, the discharge operation valve element is closed by the valve-opening groove and when the pilot valve element is positioned in the vicinity of the upper dead point thereof, the supply valve element is opened by the upper portion of the pilot element which pushes up the supply operation valve element against the urging force of the valve-closing spring.

4. An apparatus for driving a piston by fluid pressure as claimed in claim 1, wherein the piston is driven by the pressure of compressed air.

5. An apparatus for driving a piston by fluid pressure as claimed in claim 1, wherein a plunger provided in a hydraulic pump is connected to the piston provided in the engine.

* * * * *